US008852019B2

(12) United States Patent
Evans et al.

(10) Patent No.: US 8,852,019 B2
(45) **Date of Patent: *Oct. 7, 2014**

(54) VARIABLE LENGTH GOLF CLUB SHAFT

(71) Applicant: Callaway Golf Company, Carlsbad, CA (US)

(72) Inventors: D. Clayton Evans, San Marcos, CA (US); Tim Goudarzi, San Marcos, CA (US); Matthew T. Cackett, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 97 days.

This patent is subject to a terminal disclaimer.

(21) Appl. No.: 13/931,535

(22) Filed: Jun. 28, 2013

(65) Prior Publication Data

US 2013/0303299 A1 Nov. 14, 2013

Related U.S. Application Data

(60) Division of application No. 13/100,140, filed on May 3, 2011, now Pat. No. 8,529,367, which is a continuation-in-part of application No. 13/038,254, filed on Mar. 1, 2011, now Pat. No. 8,454,451, which is a continuation-in-part of application No. 13/008,806, filed on Jan. 18, 2011, now Pat. No. 8,425,344.

(60) Provisional application No. 61/422,982, filed on Dec. 14, 2010.

(51) Int. Cl.
*A63B 53/16* (2006.01)

(52) U.S. Cl.
USPC ..... 473/296; 473/299

(58) Field of Classification Search
CPC ..... A63B 53/16
USPC ..... 473/239–299, 300–303
See application file for complete search history.

(56) References Cited

U.S. PATENT DOCUMENTS

| | | | | |
|---|---|---|---|---|
| 1,026,990 | A * | 5/1912 | Matson | 473/519 |
| 1,704,544 | A * | 3/1929 | Novak | 473/299 |
| 5,586,946 | A * | 12/1996 | Haber et al. | 473/295 |
| 6,939,237 | B1 * | 9/2005 | Voden | 473/44 |
| 7,704,161 | B2 * | 4/2010 | Lindner | 473/297 |
| 2005/0143186 | A1 * | 6/2005 | Blattner et al. | 473/296 |
| 2006/0183563 | A1 * | 8/2006 | Nemeckay | 473/239 |
| 2008/0081708 | A1 * | 4/2008 | Wilmsen et al. | 473/297 |
| 2009/0270197 | A1 * | 10/2009 | Holtzman | 473/296 |
| 2010/0081515 | A1 * | 4/2010 | White et al. | 473/296 |
| 2011/0159982 | A1 * | 6/2011 | Takeuchi | 473/299 |

* cited by examiner

*Primary Examiner* — Stephen L. Blau
(74) *Attorney, Agent, or Firm* — Rebecca Hanovice; Michael A. Catania; Sonia Lari

(57) ABSTRACT

A variable length shaft assembly comprising at least one upper shaft portion, a lower shaft portion and a threaded fastener, wherein the threaded fastener removably connects the upper shaft portion to the lower shaft portion, is disclosed herein. The variable length shaft assembly may further comprise at least two upper shaft portions having different lengths so a golfer can adjust the total length of the shaft by removing one upper shaft portion and replacing it with another upper shaft portion having a different length. Methods of adjusting the length of a golf club shaft without damaging any portion of the shaft and variable length shaft kits are also disclosed herein.

14 Claims, 13 Drawing Sheets

VARIABLE LENGTH GOLF CLUB SHAFT

CROSS REFERENCES TO RELATED APPLICATIONS

The present application is a divisional of U.S. patent application Ser. No. 13/100,140, filed on May 3, 2011, which is a continuation-in-part of U.S. patent application Ser. No. 13/038,254, filed on Mar. 1, 2011, and issued as U.S. Pat. No. 8,454,451 on Jun. 4, 2013, which is a continuation-in-part of U.S. patent application Ser. No. 13/008,806, filed on Jan. 18, 2011, and issued as U.S. Pat. No. 8,425,344 on Apr. 23, 2013, which claims priority to U.S. Provisional Patent Application No. 61/422,982, filed on Dec. 14, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a variable length shaft assembly that allows for quick, semi-permanent length adjustments. More specifically, the present invention relates to a variable length shaft whose length can be adjusted in a short period of time with the use of shaft components having different lengths.

2. Description of the Related Art

Customization of golf clubs to help golfers attain better shots has become a popular and more prevalent practice in recent years. Golf club manufacturers and designers have devised various features to allow club fitters and golf club players to adjust certain characteristics of their clubs. Such characteristics include loft, lie, face angle, center of gravity (CG) location, and club length.

Current technology provides two methods to adjust overall club length. One such method involves the destruction and removal of the grip on a shaft. Upon removal of the grip by peeling or tearing, the end portion of the shaft is trimmed to decrease the club length or an extension piece is affixed to the end of the shaft to increase its length. Aftermarket extensions are available specifically for this purpose; alternatively, extensions can be made from portions of other golf club shafts that are cut to the desired length and then inserted into the end of the first club's shaft. The extension piece must match the diameter of the existing shaft, so it is necessary at times to build up the diameter of the extension or existing shaft by adding layers of tape. This method requires that the user making the adjustments have access to potentially expensive new components and tools as well as having a high level of skill. It also causes damage to the original shaft and grip.

The second method of adjusting club length involves replacing the entire shaft and grip using a semi-permanent head-shaft connection device that some manufacturers offer with their clubs, particularly with drivers. The existing shaft may be removed from the driver head and replaced with a different shaft that has either a shorter or longer length. This method is not possible on all clubs, however, as the head must have hardware that allows for removal of the shaft and replacement with a new shaft without damaging the head.

A golfer who does not possess club altering skills or the necessary disposable income to purchase new components likely will be daunted by these two methods of adjusting club length. The first method requires the golfer to make use of several tools to remove the grip and cut the shaft if he or she desires a shorter length, and also to have materials such as tape and a replacement grip on hand to replace the grip and mend any damage caused to the shaft and grip. The skill set required to change the shaft length using this method is usually beyond the abilities of the average golfer, so the golfer would need to seek the services of a golf club fitter or technician to have their club length changed. The second method requires the golfer to buy an entirely new shaft at a different length, which can be very expensive, and also may require the golfer to retain a golf club fitter or technician to replace the shaft.

Ultimately, the two methods described above require an inventory of spare components and above average technical skill, particularly with regard to the first method. It is therefore desirable to facilitate the change of a club's length using a faster, easier, and less expensive system and method than is currently available.

BRIEF SUMMARY OF THE INVENTION

One aspect of the present invention is a variable length golf club shaft comprising a grip assembly comprising a grip and an upper shaft portion, a lower shaft portion, and a semi-permanent fastener, wherein no portion of the grip is located on the lower shaft portion, and wherein the semi-permanent fastener removably connects the grip assembly to the lower shaft portion. The semi-permanent fastener may be a screw, and the lower shaft portion may comprise a hosel connection portion. The semi-permanent fastener may removably connect the grip assembly to the lower shaft portion along an axis located above the hosel connection portion and below the grip, and the axis may be located no less than 11 inches and no more than 18 inches from a butt end of the grip assembly.

This aspect of the present invention may further comprise an upper adapter affixed to a lower, interior surface of the upper shaft portion, and a lower adapter affixed to an upper, interior surface of the lower shaft portion, wherein each of the upper and lower adapters comprises a bore, and wherein the semi permanent fastener is insertable through the bores of the upper and lower adapters. The upper adapter may comprise a flange. This aspect of the invention may further comprise a fastener captivator located within the upper shaft portion, wherein a fastener head is trapped within the upper adapter between the fastener captivator and the flange. The fastener captivator may be permanently attached to the upper adapter. An exterior portion of the lower adapter may comprise splines, and an interior portion of the upper adapter may also comprises splines, such that the splines on the exterior portion mate with the splines on the interior portion when the semi-permanent fastener connects the grip assembly to the lower shaft portion.

The upper and lower shaft portions of the present invention may be composed of a material selected from the group consisting of aluminum, aluminum alloy, titanium, titanium alloy, steel, magnesium, magnesium alloy, plastic, and graphite composite. The upper and lower adapters of the present invention may also be composed of a material selected from the group consisting of aluminum, aluminum alloy, titanium, titanium alloy, steel, magnesium, magnesium alloy, plastic, and graphite composite.

This aspect of the present invention may further comprise an upper o-ring disposed proximate the upper adapter and a lower o-ring disposed proximate the lower adapter. The invention may also further comprise at least two upper shaft portions, wherein the at least two upper shaft portions have different lengths. The at least two upper shaft portions may, for example, differ in length from each other by no less than 0.5 inch. The at least two upper shaft portions may differ in weight from each other, or may have the same weight.

Another aspect of the present invention is a kit comprising at least two grip assemblies, a lower shaft portion, a threaded fastener, and a tool, wherein each grip assembly comprises an upper shaft portion and a grip, wherein no grip is disposed on the lower shaft portion, wherein the at least two grip assemblies have different lengths, wherein the tool engages the threaded fastener to tighten or loosen the threaded fastener, and wherein the threaded fastener removably connects the lower shaft portion with the at least two grip assemblies.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to a variable length shaft that provides club length adjustability. Club length adjustability is an advantageous feature for golf clubs because, for example, extending the length of a club can have the desired effect of increasing club head speed, which results in longer driving distances. Conversely, shortening the length of a club would provide a golfer with more control and accuracy in driving the golf ball. Golf course conditions often require accurate driving due to hazards, including but not limited to water, rough, and out of bounds markers, and driving accuracy can be more preferred than driving distance in competitive situations.

The present invention is also valuable because a golfer's swing may change over time, thus requiring alterations to his or her clubs. A golfer may improve his or her game through lessons and may gain greater flexibility and strength through practice and exercise. As such, it is reasonable for a golfer to wish to change his or her club's length to help improve his or her accuracy, distance, and feel as needed or desired.

The present invention provides golfers with a system and method to easily, quickly and inexpensively modify the length of their golf clubs to have them perform in a desired manner. This invention will enable golfers to change their club length wherever they wish, including, but not limited to, at the practice range, the golf course, and their home. The present invention also is designed to avoid altering a club's swing weight or its "feel." The tool and components that are used to alter a club's length are small and can be carried in a pocket of the user's golf bag. Furthermore, the technical ability required to modify the golf club length according to this invention is minimal and its approach is intuitive and easy for a golfer to understand.

Figure 1:
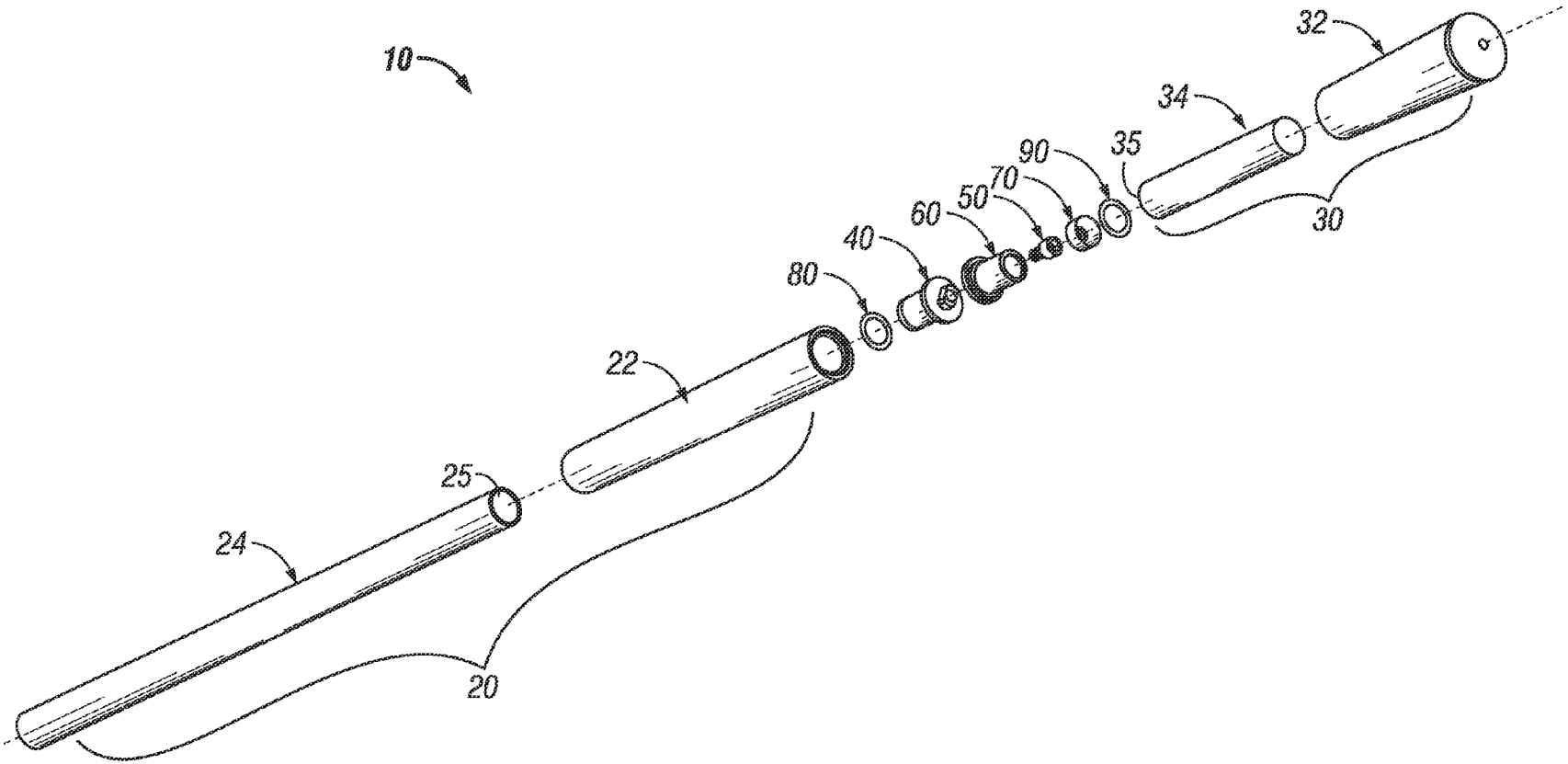
FIG. 1 is an exploded side view of an embodiment of the variable length shaft of the present invention.
Figure 2:
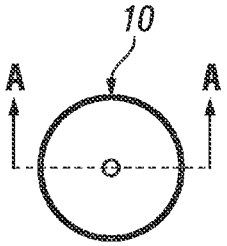
FIG. 2 is a top plan view of the embodiment shown in FIG. 1.
Figure 3:
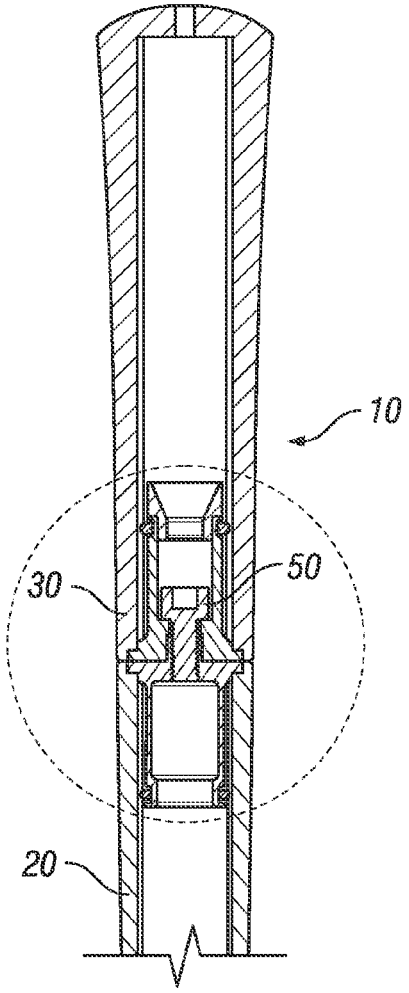
FIG. 3 is a side cross-sectional view of the embodiment shown in FIG. 2 along lines A-A.
Figure 4:
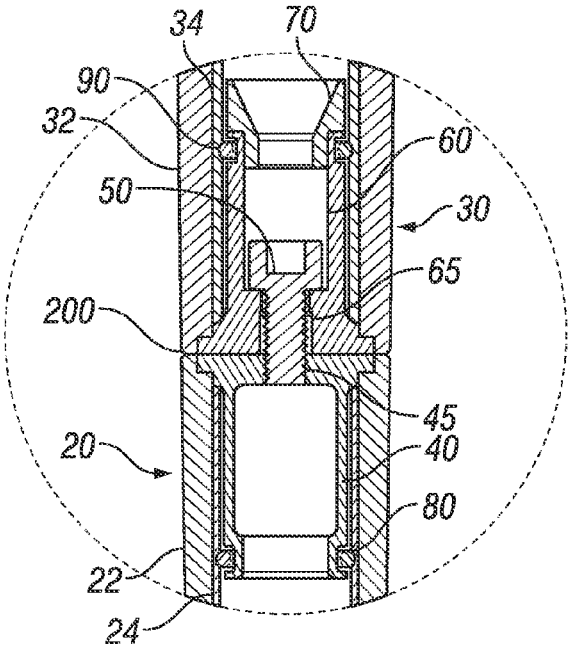
FIG. 4 is a close-up image of the circled section of the embodiment shown in FIG. 3.

A first embodiment of the present variable length shaft invention is shown in FIGS. 1-4. According to this embodiment of the invention, and as shown in FIGS. 1 and 4, two sections of the shaft 10, the lower shaft and grip section 20 and the upper shaft and grip section 30, are joined together proximate the upper end 25 and lower end 35 of the shaft portions 24, 34, respectively, along a demarcation line 200, the line at which the two shaft and grip sections 20, 30 meet.

As shown in FIGS. 1, 3, and 4, the lower shaft and grip section 20 includes a lower grip portion 22 that encircles and is affixed to a lower part of the shaft 24 with double-sided adhesive tape (not shown). In other embodiments, the lower grip portion 22 may be affixed to the shaft 24 with another type of adhesive material. A lower adapter 40 is affixed to or otherwise situated proximate the upper, interior surface of the lower part of the shaft 24, and a lower-adapter o-ring 80 may be used to seal or otherwise secure the connection between the lower adapter 40 and the interior surface of the lower part of the shaft 24, as shown in FIG. 4. The lower adapter 40 also contacts an interior surface of the lower grip portion 22 in the first embodiment of the present invention, also as shown in FIG. 4. This adapter 40 includes a threaded hole 45 in its center to receive a screw 50 that allows the adapter 40 to be fastened to the upper shaft and grip section 30.

The upper shaft and grip section 30 correspondingly as an upper grip portion 32 encircling and affixed to an upper shaft portion 34 with double-sided adhesive tape (not shown), or, in other embodiments, another kind of adhesive material. The upper shaft and grip section 30 has an upper adapter 60 affixed to or otherwise situated proximate the lower, interior surface of the upper shaft portion 34, and an upper-adapter o-ring 90 may be used to seal the connection between the upper adapter 60 and the upper shaft portion 34. The upper adapter 60 also contacts an interior surface of the upper grip portion 32 in the first embodiment of the present invention, which is also on shown in FIG. 4. The upper adapter 60 has a hole 65, which in the first embodiment is not threaded, in its center to receive the screw 50 that mates with the lower adapter 40 associated with the lower shaft and grip section 20, and is affixed to a screw captivator 70 that prevents the screw 50 from falling out of or otherwise becoming dislodged from the upper adapter 60. In another embodiment, the hole 65 can be threaded.

As shown in FIGS. 1 and 4, assembly of the first embodiment of the invention requires that the lower shaft and grip section 20 and the upper shaft and grip section 30 be aligned and pressed together in their proper orientation at a demarcation line 200, the line where the two parts connect. The screw 50 located in the upper adapter 60 is threaded into the threaded hole 45 of the lower adapter 40 and tightened with a specifically provided tool 100, as shown in FIGS. 7A, 7B, 8A, and 8B. The adapters 40, 60 may further include anti-rotational features to restrict twisting along the shaft axis when they are screwed together. When the screw 50 has been secured, the two shaft and grip sections 20, 30 are interlocked securely together, thus allowing the club to be used to hit golf balls. This operation allows for a semi-permanent assembly that will make the golf club comply with the appropriate USGA rules of golf.

Figure 5A:
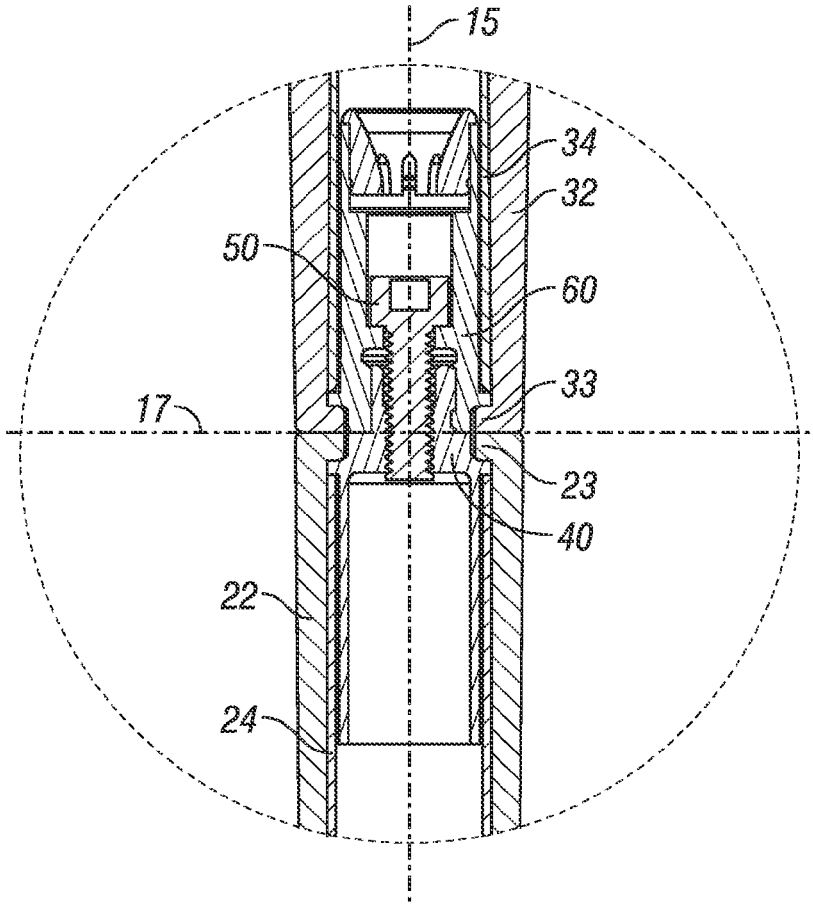
FIG. 5A is a side cross-sectional view of another embodiment of a variable length shaft connection region.

In a second embodiment, shown in FIGS. 5A and 58, the upper grip portion 32 and the lower grip portion 22 include a lip or collar 33, 23. The upper grip portion 32 collar 33 is located at a single opening of the upper grip portion 32, and the lower grip portion 22 collar 23 is located at an upper opening in the lower grip portion 22. When the upper grip portion 32 contacts the lower grip portion 22 with their respective adapters 60, 40 installed, as shown in FIG. 5A, the collars 33, 23 ensure a good fit between the upper and lower grip portions 32, 22 and consistent grip length during the gripping operation. The collars 33, 23 also help retain the adapters 60, 40 within the upper and lower grip portions 32, 22. By interfacing at a plane 17 normal to the shaft 10 axis 15, as shown in FIG. 5A, the collars 33, 23 provide greater contact between the upper and lower grip portions 32, 22, than in upper and lower grip portions that do not include collars 33, 23.

Figure 5B:
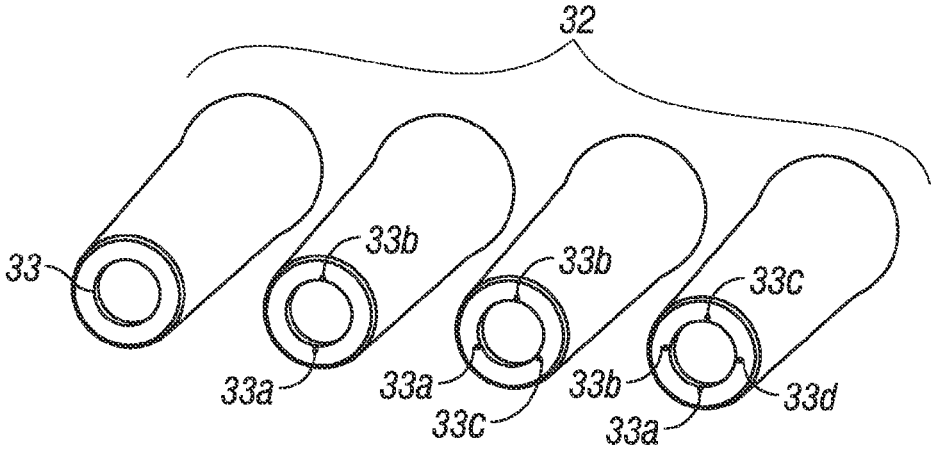
FIG. 5B is a side perspective view of an assortment of upper grip pieces having different collar configurations.

In the embodiment shown in FIG. 5B, the collar 33 of the upper grip portion 32 preferably includes one or more slits 33*a*-33*d*. These slits 33*a*-33*d* can expedite production of upper grip portions 32 having different lengths, as the inclusion of a collar 33 may make it difficult to remove a core bar used to mold the inner diameter of the upper grip portions 32. The slits 33*a*-33*d* thus allow for easier removal of the core bar from the upper grip portions 32 after molding is complete. The slits 33*a*-33*d* also make it easier to insert the upper shaft portion 34 and the upper adapter 60 into the upper grip portion 32.

Figure 6A:
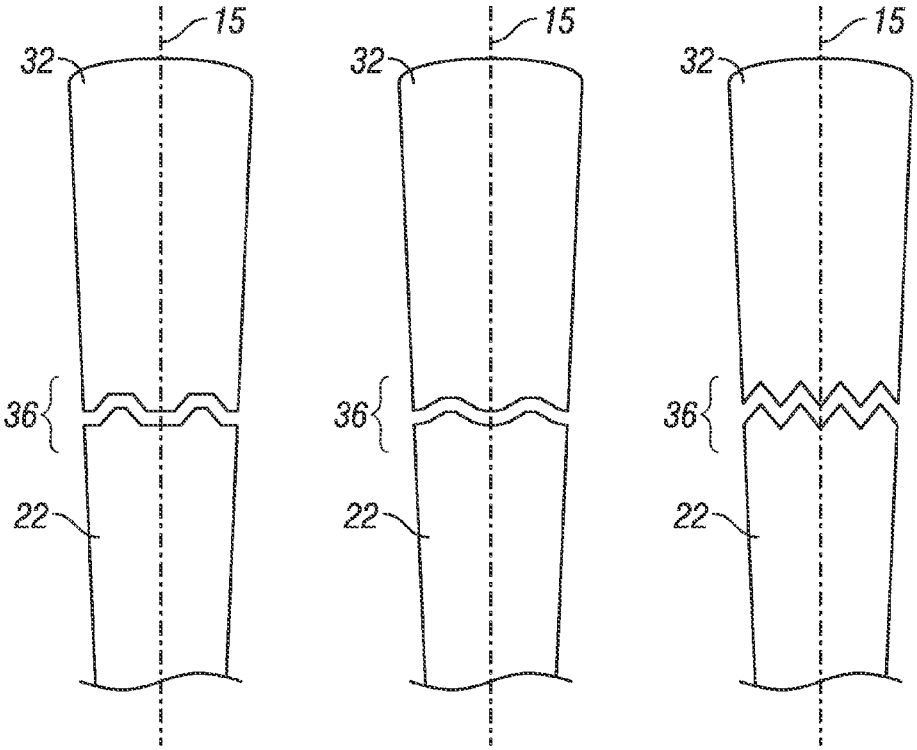
FIG. 6A is a side cross-sectional view of upper and lower grip pieces having an assortment of interlocking mating interfaces.
Figure 6B:
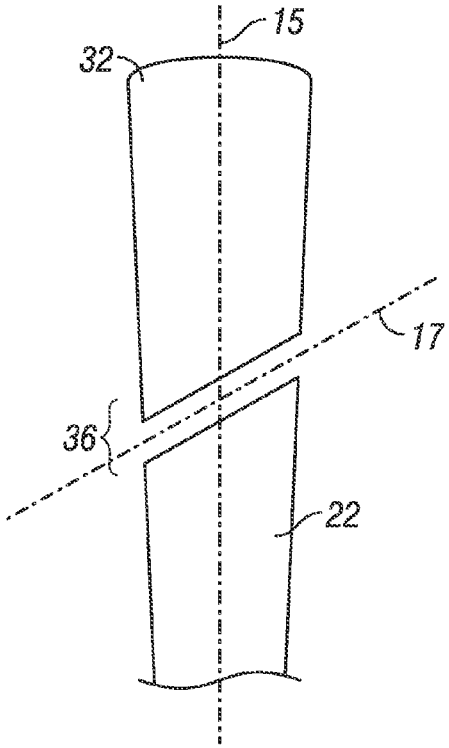
FIG. 6B is a side cross-sectional view of upper and lower grip pieces having a non-ninety degree angle mating interface.

The contact between upper and lower grip portions 32, 22 can be increased by designing an interface 36 between the upper and lower grip portions to have an interlocking design, such as one of the designs shown in FIG. 6A. The interlocking design may include serrations or may include protrusions in one grip portion 32, 22 that fit within depressions in the other grip portion 32, 22, as shown in FIG. 6A. The interlocking features between the upper and lower grip portions 32, 22 may also be used as a decorative styling and may be present on the upper and lower grip portions 32, 22 when a collar 33, 23 is present or absent. An alternative way to increase contact between the grip portions 32, 22, as shown in FIG. 6B, is to design the upper and lower grip portions to contact each with other at an interface 36 along a plane 17 having a non-ninety degree angle with respect to the shaft axis 15.

Figure 7A:
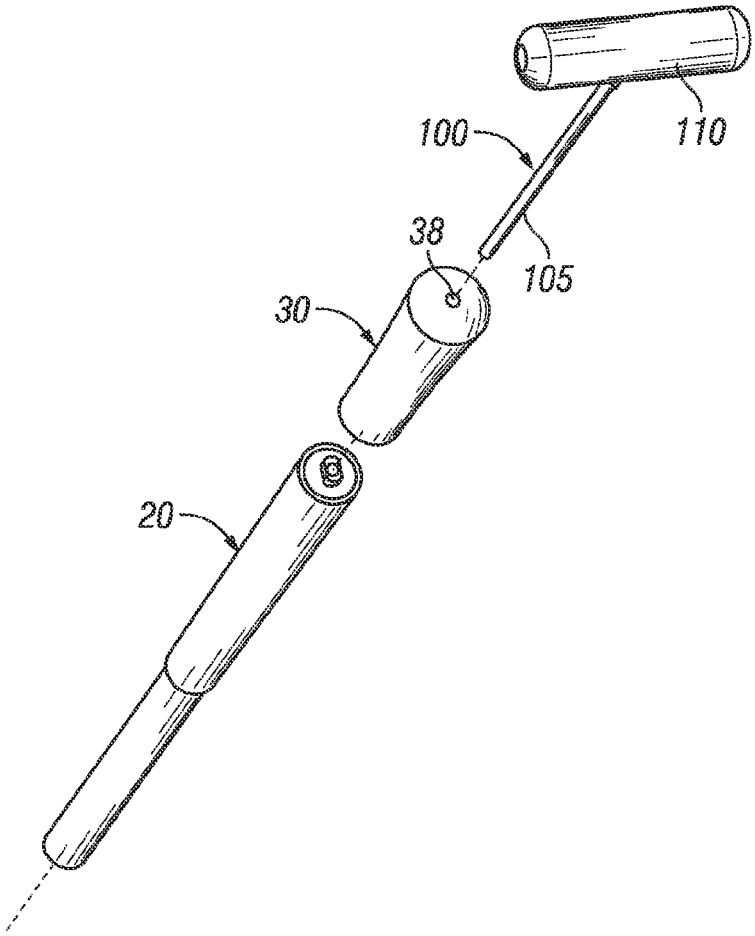
FIGS. 7A and 7B are side views of a tool interacting with the unassembled embodiment shown in FIG. 1.
Figure 7B:
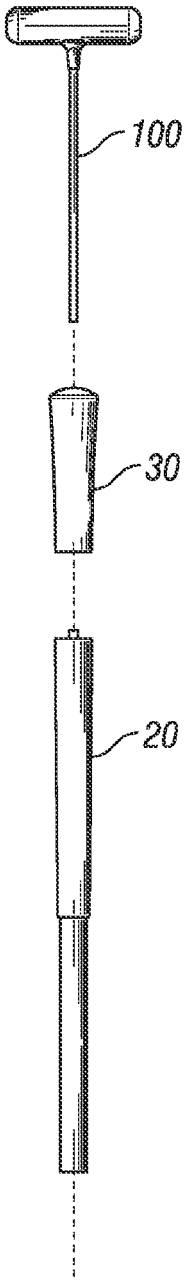
Figure 8A:
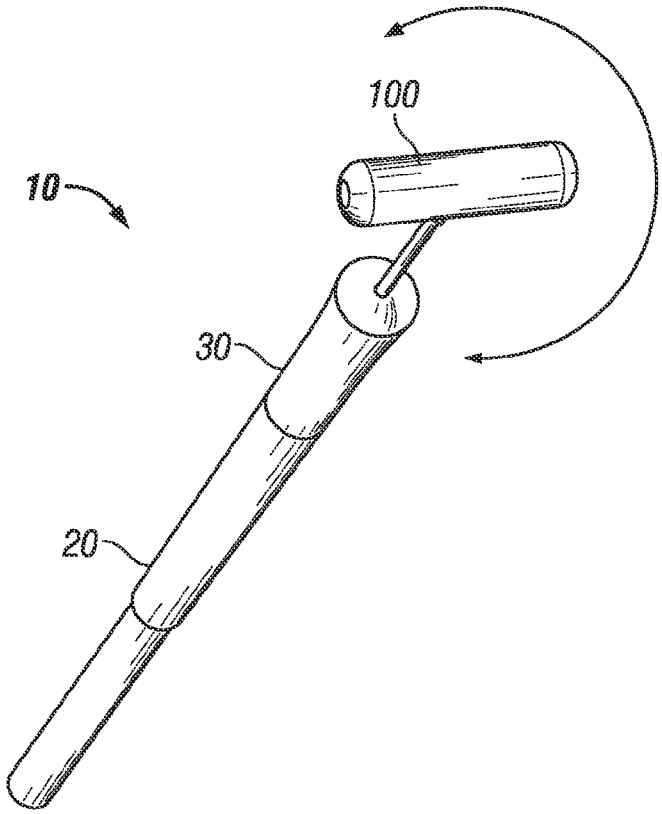
FIGS. 8A and 8B are side views of a tool interacting with the assembled embodiment shown in FIG. 1.
Figure 8B:
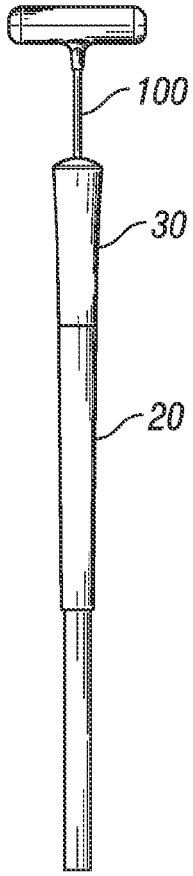

FIGS. 7A, 7B, 8A, and 8B show a tool 100, having an extension portion 105 and a head portion 110, which can be used to assemble the upper and lower shaft and grip sections 20, 30. As shown in FIG. 7A, and with reference to FIG. 4, the extension portion 105 of the tool fits through a hole 38 at the topmost portion of the upper grip portion 32, extends through the upper shaft portion 34, the screw captivator 70, and the upper adapter 60, and contacts the screw 50. The screw captivator 70 specifically guides the extension portion 105 to contact the screw 50. As shown in FIG. 8A, once the extension portion 105 of the tool 100 engages the head of the screw 50, the tool head portion 110 can be twisted clockwise or counterclockwise to tighten or loosen, respectively, the screw 50 and therefore the connection between the upper and lower shaft and grip sections 20, 30.

Figure 9:
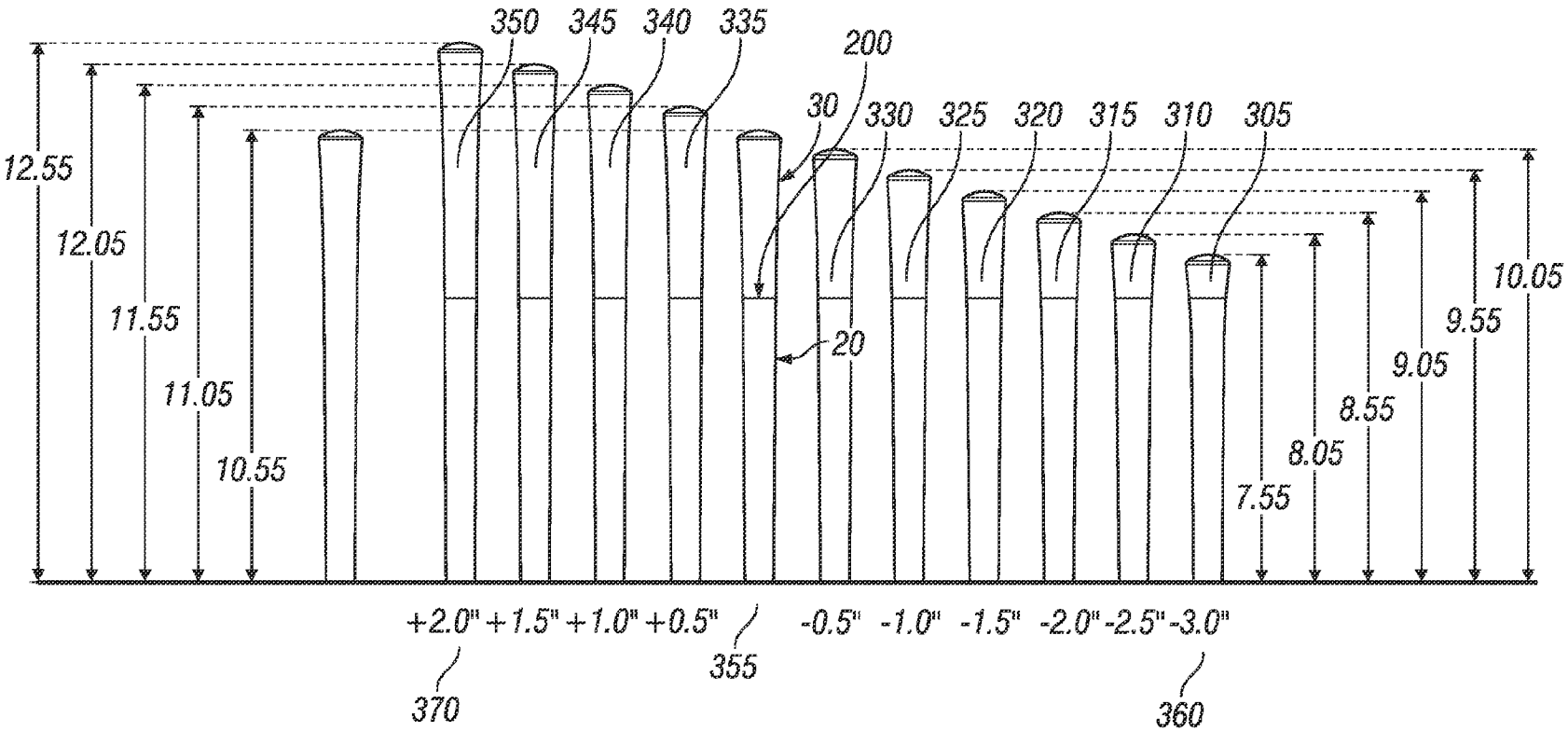
FIG. 9 is a side view of different lengths of upper shaft sections of the embodiment shown in FIG. 1.

In the first embodiment of the present invention, the length of the lower shaft and grip section 20 is not altered, as shown in FIG. 9. In other words, a golfer would not exchange the lower shaft and grip section 20 for a lower shaft and grip section 20 of a different length. The lower shaft and grip section 20 of the present invention thus can be permanently affixed to a desired golf club head (not shown). In contrast, according to the first embodiment of the present invention and as disclosed in FIG. 9, the upper shaft and grip section 30 of a normal length club 355 can be easily swapped for other upper shaft and grip sections 305, 310, 315, 320, 325, 330, 335, 340, 345, 350 having different lengths. The upper shaft and grip sections 305, 310, 315, 320, 325, 330, 335, 340, 345, 350 may also have different weights to allow the golfer to change the club weight as desired. Alternatively, the upper shaft and grip sections 305, 310, 315, 320, 325, 330, 335, 340, 345, 350 may all have the same weight.

FIG. 9 discloses an assortment of upper shaft and grip sections 30, each having different lengths such that the total club length can range from a short, 43-inch club 360 to a long, 48-inch club 370. The assortment of upper shaft and grip sections 30, 305, 310, 315, 320, 325, 330, 335, 340, 345, 350, shown in FIG. 9 may all be sold to a golfer with the lower shaft and grip section 20 in a kit form, or a smaller selection of such upper shaft and grip sections 30 may be included in a kit. As such, if a golfer wishes to increase the length of a shaft, he or she may remove the upper shaft and grip section 30 using the tool 100 and replace it with an upper shaft and grip section 30 having a greater length 335, 340, 345, 350. In contrast, if the golfer wishes to decrease the length of the shaft, he or she may remove the upper shaft and grip section 30 using the tool 100 and replace it with an upper shaft and grip section having a shorter length 305, 310, 315, 320, 325, 330. This invention thus allows the golfer to increase or decrease the length of a golf club shaft without detaching the lower shaft and grip section 20 from the club head or cutting or otherwise damaging any part of the shaft or grip.

In another, preferred, embodiment of the invention, shown in FIGS. 10-15, the length of the shaft 1100 is adjusted in a manner that is similar to the one described above, but without the use of grip portions 22, 32. This embodiment involves connection between two sections of shaft 1100 without necessarily changing the size of the grip 1400.

Figure 10:
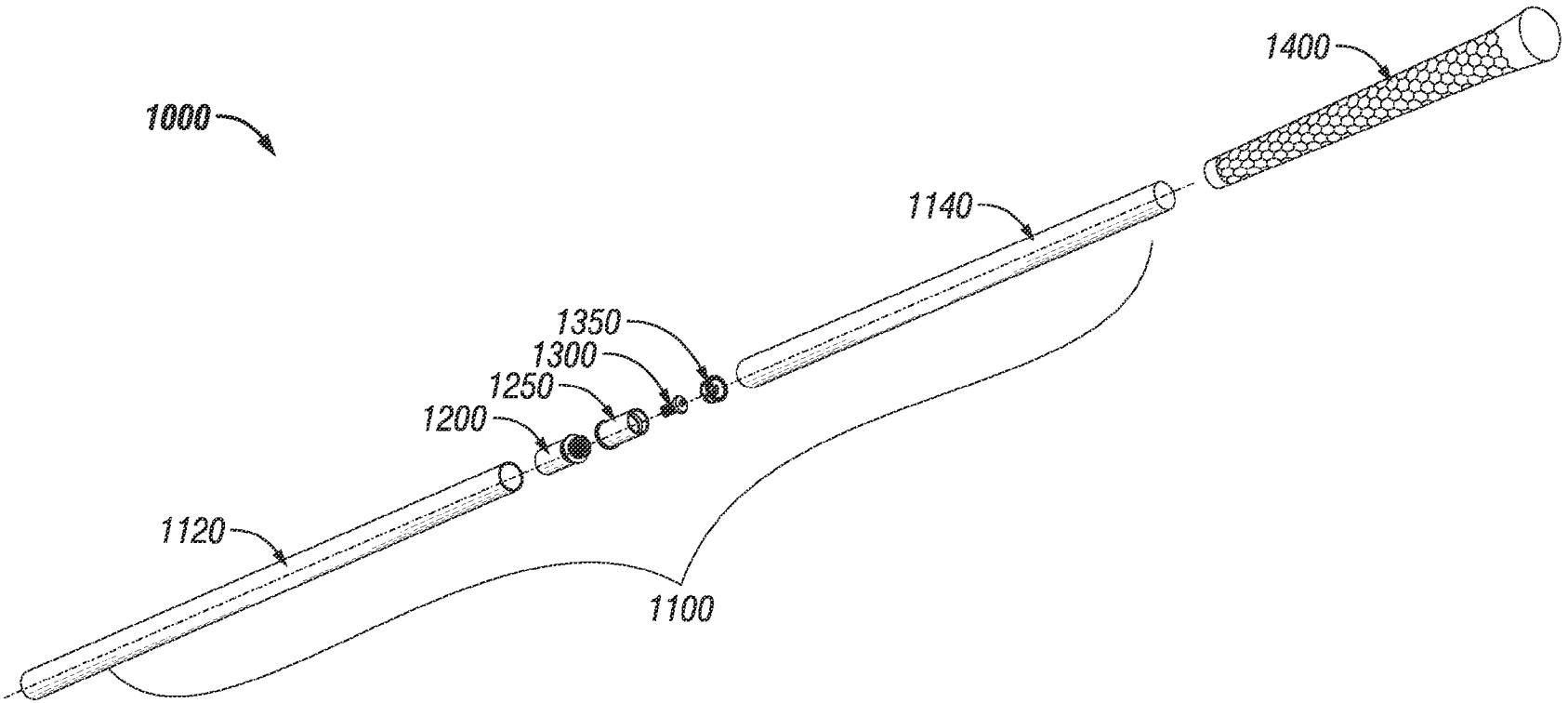
FIG. 10 is an exploded side view of another embodiment of the variable length shaft of the present invention.

As shown in FIG. 10, the preferred embodiment 1000 comprises a shaft 1100 with a lower shaft portion 1120 and an upper shaft portion 1140, a lower, shaft-side adapter 1200, an upper, grip-side adapter 1250, a fastener 1300, a fastener captivator 1350, and a grip 1400. O-rings (not shown) may also be provided proximate the adapters 1200, 1250. The lower and upper shaft portions 1120, 1140 preferably are hollow. The grip 1400 may be pre-installed on the upper shaft portion 1140 before assembly of the embodiment 1000, or the grip 1400 may be added to the upper shaft portion 1140 after assembly of the embodiment 1000 using double-sided adhesive tape or another adhesive material. In the preferred embodiment, the fastener 1300 is a screw.

Figure 11A:
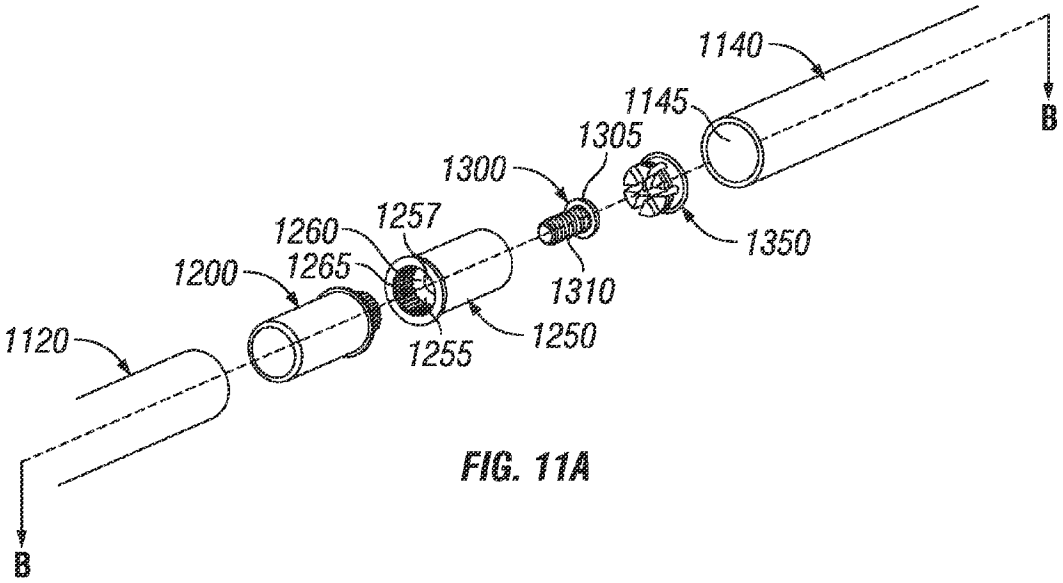
FIG. 11A is an exploded side view of a portion of the embodiment shown in FIG. 10.
Figure 11B:
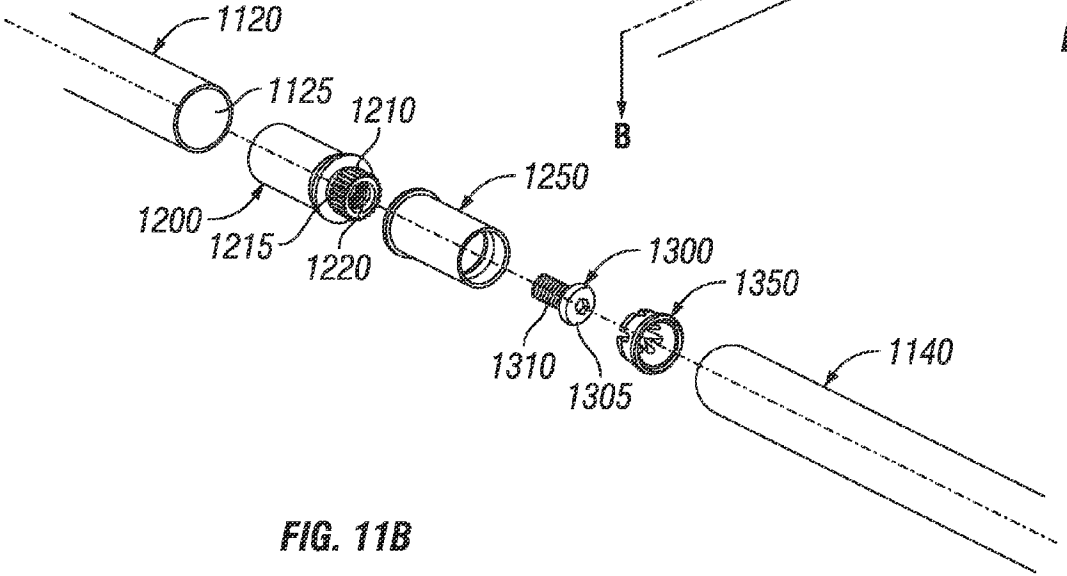
FIG. 11B is an exploded side view of a portion of the embodiment shown in FIG. 10.

FIGS. 11A and 11B show how the pieces of this embodiment 1000 are assembled. The shaft-side adapter 1200 is installed in an upper, interior region 1125 of the lower shaft portion 1120, opposite a club head (not shown), and the grip-side adapter 1250 is installed in a lower, interior region 1145 of the upper shaft portion 1140, opposite the grip 1400. The screw 1300 is threaded through a 1257 hole in the grip-side adapter 1250 such that the head 1305 of the screw 1300 rests against a flange 1255 in the grip-side adapter 1250 and cannot fall out of the grip-side adapter 1250. The fastener captivator 1350 is sized to rest against or within the grip-side adapter 1250, thus trapping the head 1305 of the screw 1300 within the grip-side adapter 1250.

As shown in FIGS. 11A and 11B, the shaft-side adapter 1200 has an extension portion 1210 with an exterior surface 1215 that aids in alignment and acts as an anti-rotational feature. In the preferred embodiment, the exterior alignment surface 1215 possesses splines and grooves. In alternative embodiments, the exterior alignment surface 1215 may instead have polygonal surfaces, serrations, teeth, or other alignment/anti-rotational features. The extension portion 1210 includes a threaded hole 1220, which receives the body 1310 of the screw 1300 and, upon tightening of the screw, provides axial rigidity to the upper shaft portion 1140.

Also shown in FIGS. 11A and 11B, the grip-side adapter 1250 has a recessed portion 1260 with an interior surface 1265 that has alignment/anti-rotational features to mate with the alignment/anti-rotational features of the exterior surface 1215 of the extension portion 1210 of the shaft-side adapter 1200. In the preferred embodiment, shown in these Figures, the interior alignment surface 1265 has splines and grooves that mate with the splines and grooves on the exterior alignment surface 1215 of the shaft-side adapter 1200. In alternative embodiments, the interior alignment surface 1265 has polygonal surfaces or sides, grooves, notches, or other alignment/anti-rotational features.

Figure 12B:
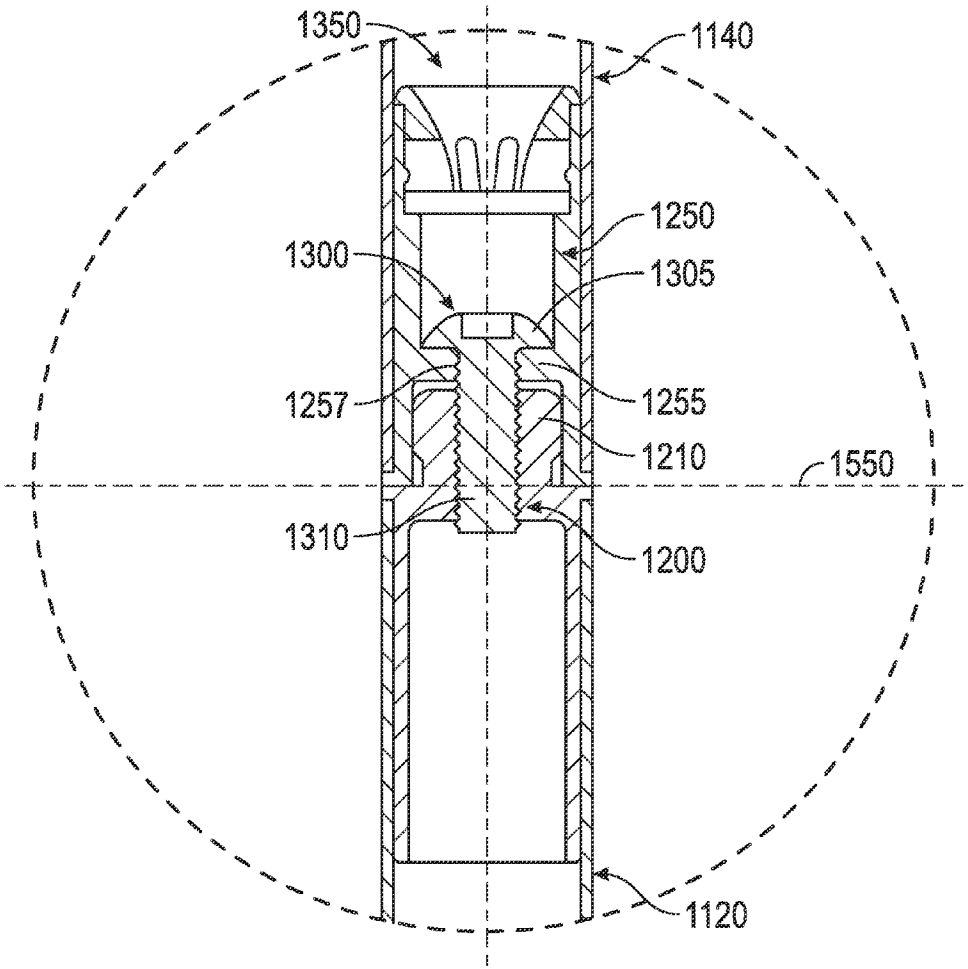
FIG. 12B is a close-up image of the circled section of the embodiment shown in FIG. 12A.
Figure 12A:
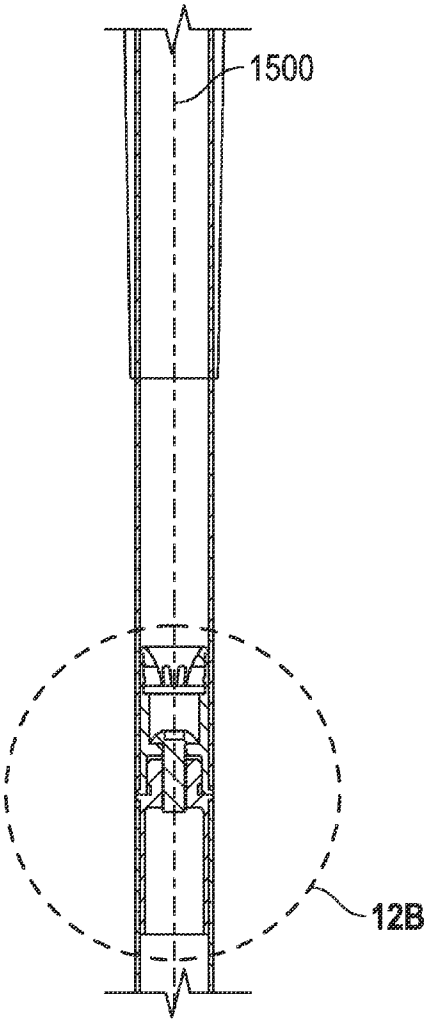
FIG. 12A is a cross-sectional view of the embodiment shown in FIG. 11A, when fully assembled, along lines B-B.

FIG. 12A shows a cross-section of the preferred embodiment in fully assembled form along lines B-B of FIG. 11A. FIG. 12B is an enlarged view of the assembly of the present invention. As shown in FIG. 12B, the shaft-side adapter 1200 is snugly installed in the upper, interior region 1125 of the lower shaft portion 1120, and the grip-side adapter 1250 is snugly installed in the lower, interior region 1145 of the upper shaft portion 1140, such that lower surfaces of the two adapters 1200, 1250 make contact along an assembly axis 1550. The assembly axis may be perpendicular to the shaft axis 1500, or may form another angle with respect to the shaft axis 1500. The fastener captivator 1350 traps the head 1305 of the screw 1300 within the grip-side adapter 1250, the body 1310 of the screw 1300 is threaded through the hole 1257 in the grip-side adapter 1250, and the head 1305 of the screw 1300 rests against the flange 1255. The grip-side adapter 1250 hole 1257 includes threads to engage the threads of the screw body 1310. The screw body 1310 extends through the hole 1257 and engages the threads within the hole 1220 of the extension portion 1210 of the shall-side adapter 1200.

When the screw body 1310 is engaged with the extension portion 1210 hole 1220 and tightened, the extension portion 120 is pulled into the recessed portion 1260, thus aligning the adapters 1200, 1250 and the shaft portions 1120, 1140 in an orientation prescribed by the splined interface. The screw 1300 is tightened to a targeted torque value using a tool such as the torque limiting wrench shown in FIGS. 13A-13B. The spline features of both adapters 1200, 1250 not only aid in the alignment of the adapters 1200, 1250 and shaft portions 1120, 1140, but act as anti-rotational features to restrict the two shaft portions 1120, 1140 from twisting relative to one another along the shaft axis 1500 during usage. When the screw 1300 is tightened, the two shaft portions 1120, 1140 are securely interlocked together, making the club shaft 1000 sturdy, durable and capable of hitting golf balls without loosening, buzzing, rattling or twisting apart. This operation provides a semi-permanent assembly complies with the appropriate USGA rules of golf.

Figure 13A:
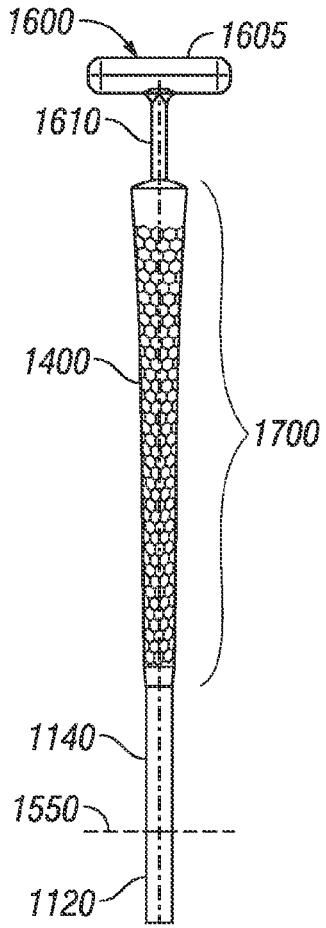
FIG. 13A is a side view of a tool interacting with the assembled embodiment shown in FIG. 10.
Figure 13B:
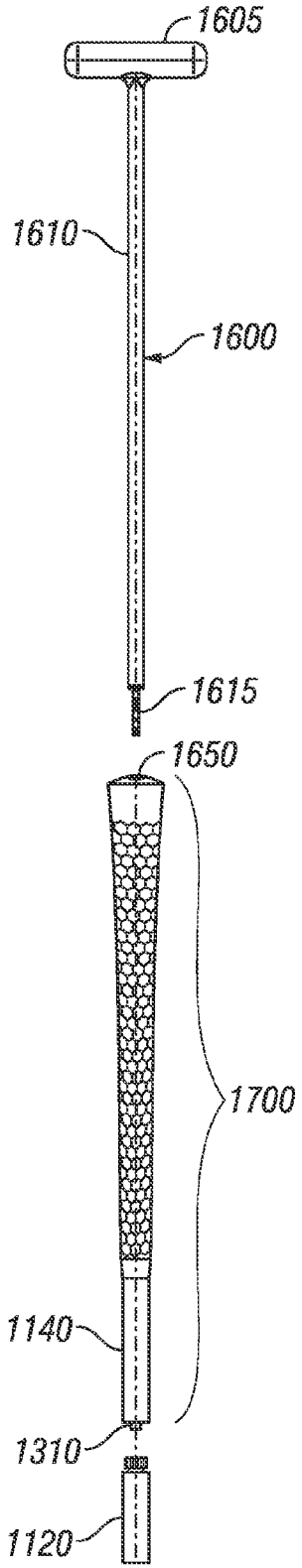
FIG. 13B is a side view of a tool interacting with the unassembled embodiment shown in FIG. 10.

FIGS. 13A and 13B show a tool 1600 having a head portion 1605, an extension portion 1610, and a tool portion 1615 that mates with the screw head 1305 interfacing with the assembly of the present invention. The lower shaft portion 1120 is secured to the upper shaft portion 1140 which, when the grip is installed 1400, creates a combined grip assembly 1700. The grip 1400 and the upper shaft portion 1140 each include a channel 1650 sized to receive the extension portion 1610 of the tool 1600, which extends through the length of the grip assembly 1700 and permits the tool portion 1615 to engage with the screw head 1305. As shown in FIG. 13A, the lower shaft portion 1120 is disengaged from the grip assembly 1700 by inserting the extension portion into the channel 1650 and engaging the tool portion 1615 with the screw head 1305 (not shown). As shown in FIG. 13B, once the tool portion 1615 interfaces with the screw head 1305, twisting the tool 1600 to loosen the screw 1300 disengages the grip assembly 1700 from the lower shaft portion 1120.

Figure 14A:
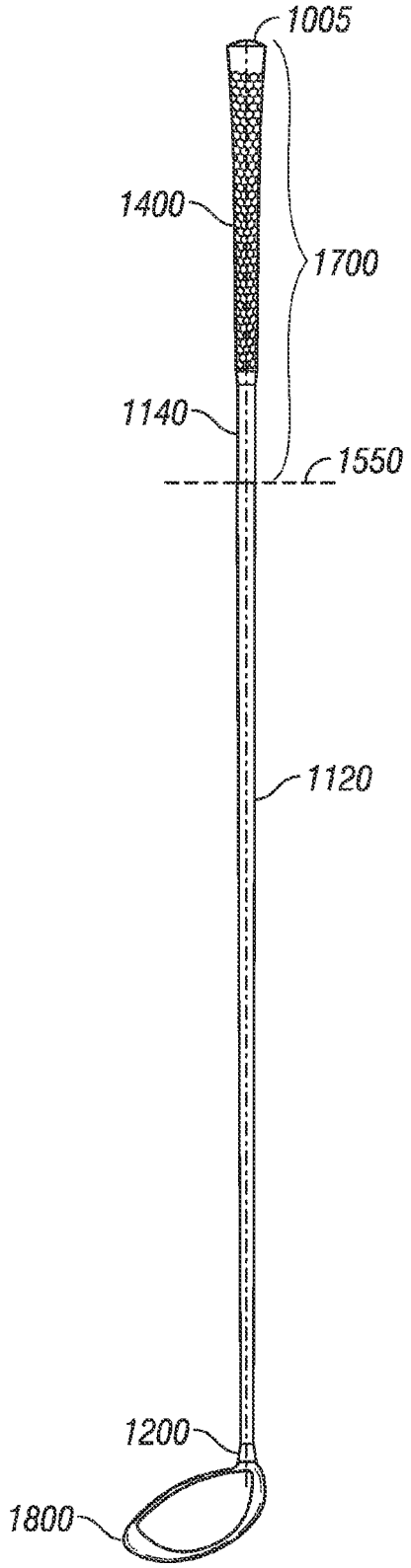
FIG. 14A is a side view of the assembled embodiment shown in FIG. 10 with golf club head.
Figure 14B:
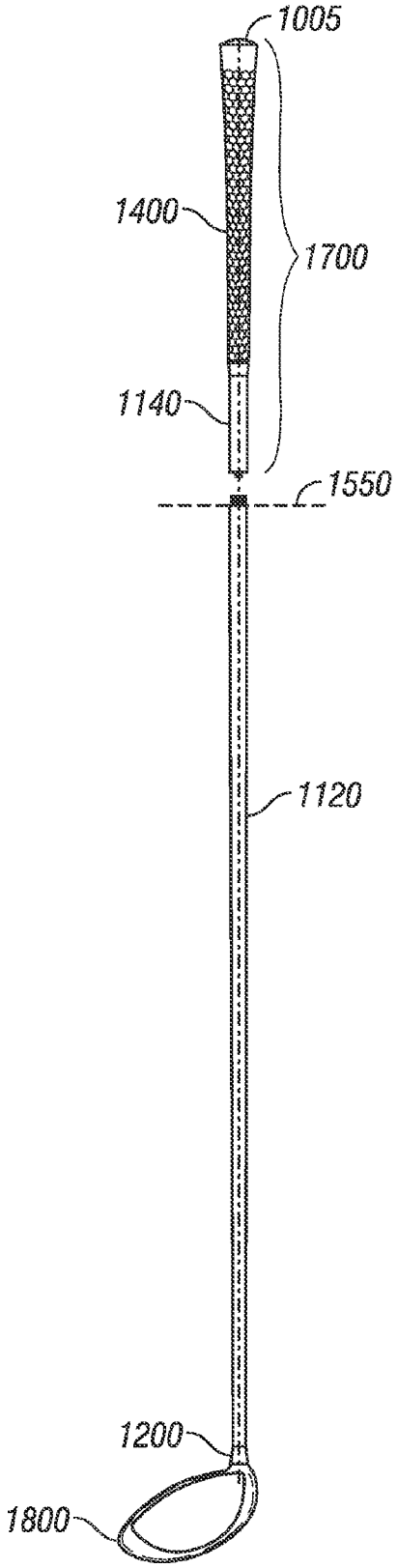
FIG. 14B is a side view of the unassembled embodiment shown in FIG. 10 with a golf club head.

FIGS. 14A and 14B show the grip assembly 1700 in assembled and disassembled configurations with respect to a lower shaft portion 1120 engaged with a golf club head 1800. The assembly axis 1550 may be located at different locations between the tip end 1002 and butt end 1005 of the shaft 1000 in different embodiments. The butt end 1005 of the shaft 1000 in FIGS. 14A and 14B is located within the grip 1400, and the tip end 1002 is located within a hosel portion of the golf club head 1800. For example, in one embodiment the assembly axis 1550 is located 11 inches from the butt end 1005 of the shaft 1000. In other embodiments, the assembly axis 1550 may be located anywhere from 11.5 inches to 18 inches from the butt end 1005 of the shaft 1000. The assembly axis 1550 location may also be referenced with respect to the tip end 1002 of the shaft. These assembly axis 1550 locations referenced herein are merely examples for different embodiments of the invention and are not intended to be limiting.

Figure 15:
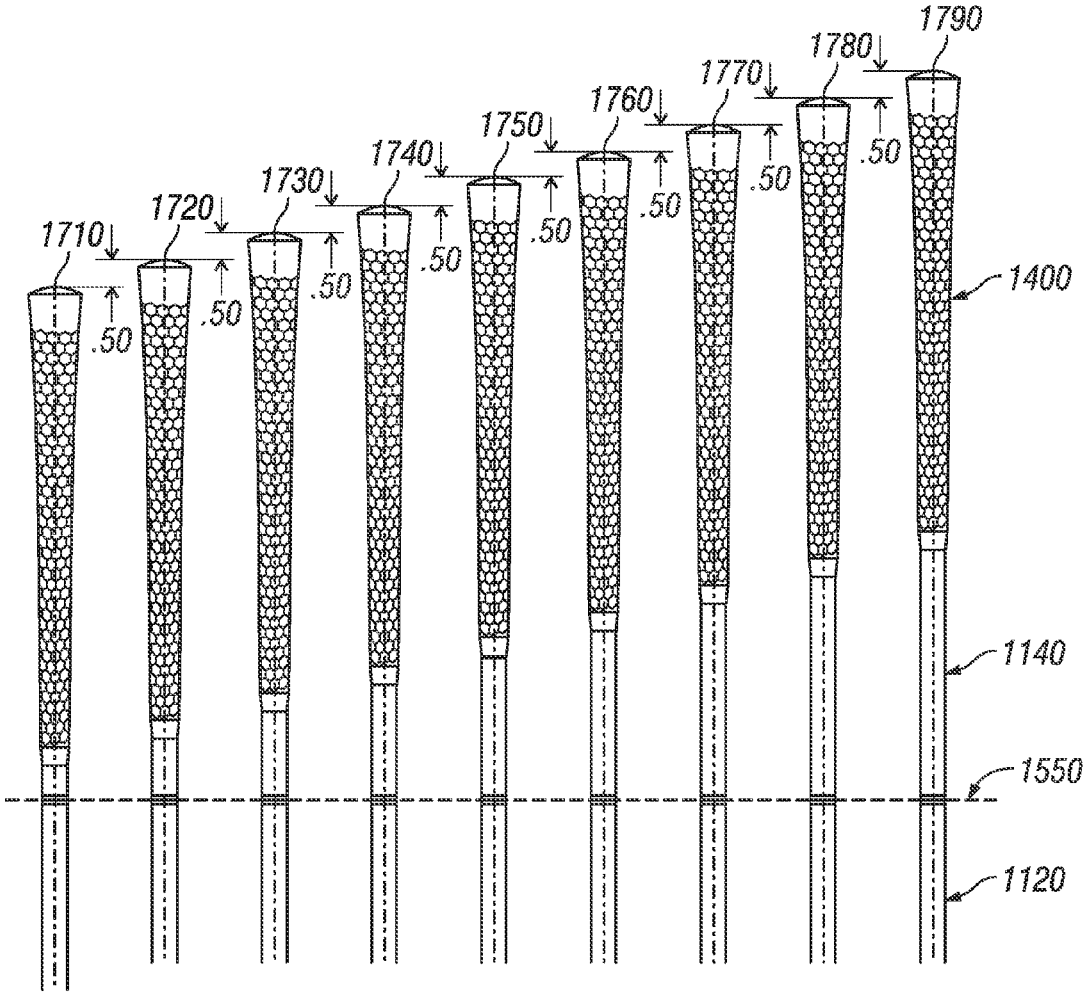
FIG. 15 is a side view of different lengths of grip assemblies of the embodiment shown in FIG. 10.

FIG. 15 shows discloses an assortment of grip assemblies 1710, 1720, 1730, 1740, 1750, 1760, 1770, 1780, 1790, each having different lengths in half-inch increments, such that the total club length can range from a short, 44-inch club to a standard, 46-inch club, to a long, 48-inch club. The grip assemblies 1710, 1720, 1730, 1740, 1750, 1760, 1770, 1780, 1790 may also have different weights to allow the golfer to change the club weight as desired. Alternatively, the grip assemblies 1710, 1720, 1730, 1740, 1750, 1760, 1770, 1780, 1790 may all have the same weight.

The assortment of grip assemblies 1710, 1720, 1730, 1740, 1750, 1760, 1770, 1780, 1790 shown in FIG. 15 may all be sold to a golfer with the lower shaft portion 1120 in a kit form, or a smaller selection of such grip assemblies 1700 may be eluded in a kit. As such, if a golfer wishes to increase the length of the shaft 1000, he or she may remove the grip assembly 1750 that creates a standard, 46-inch shaft length using the tool 1600 and replace it with an grip assembly 1760, 1770, 1780, 1790 having a greater length. In contrast, if the golfer wishes to decrease the length of the shaft 1000, he or she may remove the grip assembly 1750 using the tool 1600 and replace it with an grip assembly 1710, 1720, 1730, 1740 having a shorter length.

Throughout this process, the lower shaft portion 1120 never has to be changed, and, in contrast to other embodiments disclosed herein, the grip 1400 can have the same length regardless of the shaft length. This invention thus allows the golfer to increase or decrease the length of a golf club shaft without detaching the lower shaft portion 1120 from the club head or cutting or otherwise damaging any part of the shaft 1000 or grip 1400, and without having to make any adjustments to the grip 1400.

The parts of the embodiments of the present invention may be composed of any number of materials, including metals, plastics, rubbers, and composites. The shaft portions, screws, the screw captivators, adapters, and tools may be composed of titanium, graphite or carbon composite, plastic, magnesium, aluminum, steel, or alloys of such materials, specifically stainless steel 17-7 or titanium 6-4. The shaft portions preferably are composed of graphite. The grip portions and the o-rings preferably are composed of a rubber material. The screws, the adapters, and the screw captivators preferably are composed of a metal material. The pieces of the embodiments disclosed herein may also be bonded together with an adhesive to prevent unwanted separation and ensure adequate strength during club use.

From the foregoing it is believed that those skilled in the pertinent art will recognize the meritorious advancement of this invention and will readily understand that white the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A kit comprising:

at least two grip assemblies;

a lower shaft portion;

a threaded fastener comprising a head;

a lower adapter affixed to an upper, interior surface of the lower shaft portion; and a tool;

wherein each grip assembly comprises an upper shaft portion, a fastener captivator located within the upper shaft portion, a grip, and an upper adapter affixed to a lower, interior surface of the upper shaft portion, wherein the upper adapter comprises a flange, wherein each of the upper and lower adapters comprises a bore, and wherein the fastener is insertable through the bores of the upper and lower adapters, wherein the fastener head is trapped within the upper adapter between the fastener captivator and the flange, wherein no grip is disposed on the lower shaft portion, wherein the at least two grip assemblies have different lengths, wherein the tool engages the threaded fastener to tighten or loosen the threaded fastener, and wherein the threaded fastener removably connects the lower shaft portion with one of the at least two grip assemblies.

2. The kit of claim 1, wherein the threaded fastener is a screw.

3. The kit of claim 1, wherein the lower shaft portion comprises a hosel connection portion.

4. The kit of claim 3, wherein the fastener removably connects one of the at least two grip assemblies to the lower shaft portion along an axis located above the hosel connection portion and below the grip.

5. The kit of claim 4, wherein the axis is located no less than 11 inches and no more than 18 inches from a butt end of the grip assembly.

6. The kit of claim 1, wherein the fastener captivator is permanently attached to the upper adapter.

7. The kit of claim 1, wherein an exterior portion of the lower adapter comprises splines, wherein an interior portion of the upper adapter comprises splines, and wherein the splines on the exterior portion mate with the splines on the interior portion when the semi-permanent fastener connects the grip assembly to the lower shaft portion.

8. The kit of claim 1, wherein the upper shaft portion is composed of a material selected from the group consisting of aluminum, aluminum alloy, titanium, titanium alloy, steel, magnesium, magnesium alloy, plastic, and graphite composite.

9. The kit of claim 1, wherein the lower shaft portion is composed of a material selected from the group consisting of aluminum, aluminum alloy, titanium, titanium alloy, steel, magnesium, magnesium alloy, plastic, and graphite composite.

10. The kit of claim 1, wherein the upper adapter is composed of a material selected from the group consisting of aluminum, aluminum alloy, titanium, titanium alloy, steel, magnesium, magnesium alloy, plastic, and graphite composite.

11. The kit of claim 1, wherein the lower adapter is composed of a material selected from the group consisting of aluminum, aluminum alloy, titanium, titanium alloy, steel, magnesium, magnesium alloy, plastic, and graphite composite.

12. The kit of claim 1, further comprising an upper o-ring disposed proximate the upper adapter and a lower o-ring disposed proximate the lower adapter.

13. The kit of claim 1, wherein the at least two grip assemblies differ in length from each other by no less than 0.5 inch.

14. The kit of claim 1, wherein the at least two grip assemblies have the same weight.

* * * * *